US006119349A

United States Patent [19]

Chuan

[11] Patent Number: 6,119,349

[45] Date of Patent: Sep. 19, 2000

[54] CIGAR CUTTING DEVICE

[76] Inventor: Chin-Chung Chuan, No.183, Sec. 2, Shu-Lin St., Tainan, Taiwan

[21] Appl. No.: 09/330,202

[22] Filed: Jun. 11, 1999

[51] Int. Cl.[7] ..... A24F 13/24

[52] U.S. Cl. ..... 30/111; 30/109

[58] Field of Search ..... 30/109, 111, 363, 30/364, 301, 316; 131/253, 255

[56] References Cited

U.S. PATENT DOCUMENTS 2,545,237 3/1951 Maby ..... 30/301 X

*Primary Examiner*—Douglas D. Watts

*Attorney, Agent, or Firm*—Charles E. Baxley, Esq.

[57] ABSTRACT

A cigar cutting device includes three cutting units with different sizes and the three cutting units are threadedly and telescopically connected with each other. Each cutting unit has a sharp edge defined in a distal end thereof. A push rod has the first end thereof extending through the cutting device and the second of the push rod has an end member located outside of the cutting device. A spring is mounted to the push rod and is biased between an annular flange of the central cutting unit and a flange of the push rod so that the push rod can be pushed from the end member to push the cigar form the cutting unit and returns to its original position by the spring.

5 Claims, 4 Drawing Sheets

CIGAR CUTTING DEVICE

FIELD OF THE INVENTION

The present invention relates to a cigar cutting device, and more particularly, to an improved cigar cutting device comprising three cutting units telescopically connected with each other and a push rod extending through the device so as to push the cigar end out from the cutting unit.

BACKGROUND OF THE INVENTION

A conventional cigar cutting device 10 is shown in FIG. 4 and comprises a handle 12 and a cutting tube 11 connected to one end of the handle 12, a cap 13 is mountable to the cutting tube 11. The cutting tube 11 has a sharp edge defined in the distal end thereof so as to cut a circular slit in an end of a cigar. The cap 13 prevents the sharp edge from cutting the users. Nevertheless, the diameter of the sharp edge of the cutting tube 11 is fixed and cannot be adjusted, so that there many sizes of the cutting tubes 11 to be sold in the market. In other words, the users have to prepare many cigar cutting devices 10 so that different size of cigars can be suitably cut. This is not convenient for the users and these cigar cutting devices 10 are not easily carried with the users.

The present invention intends to provide an improved cigar cutting device which has three cutting units telescopically connected with each other so that the users carry only one cigar cutting device of the present invention and can properly cut the cigars with different sizes.

SUMMARY OF THE INVENTION

In accordance with one aspect of the present invention, a cigar cutting device comprises a first cutting unit, a second cutting unit telescopically connected to the first cutting unit, and a cap mounted to the first cutting unit. The first cutting unit has a first tube and a first cutting member extends from the first tube. The first cutting member has a first sharp edge, a first outer threaded periphery, and a first inner threaded periphery.

The second cutting unit has a second tube and a second cutting member extends from the second tube. The second cutting member has a second sharp edge and a second outer threaded periphery which is connected to the first inner threaded periphery of the first cutting unit. The cap is threadedly connected to the first outer threaded periphery of the first cutting unit.

The object of the present invention is to provide a cigar cutting device having a plurality of cutting units with different sizes.

Another object of the present invention is to provide a cigar cutting device having a push rod extending through the cutting device.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
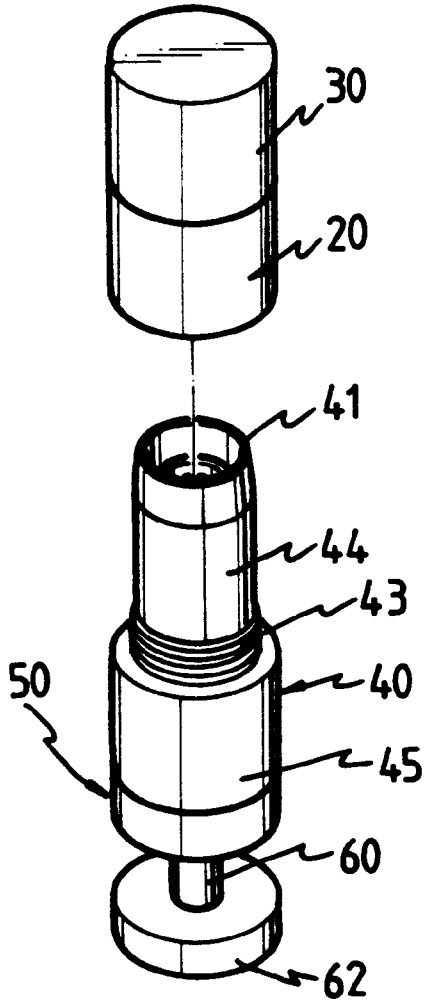
FIG. 1 is an exploded view of a cap and the cigar cutting device in accordance with the present invention.
Figure 2:
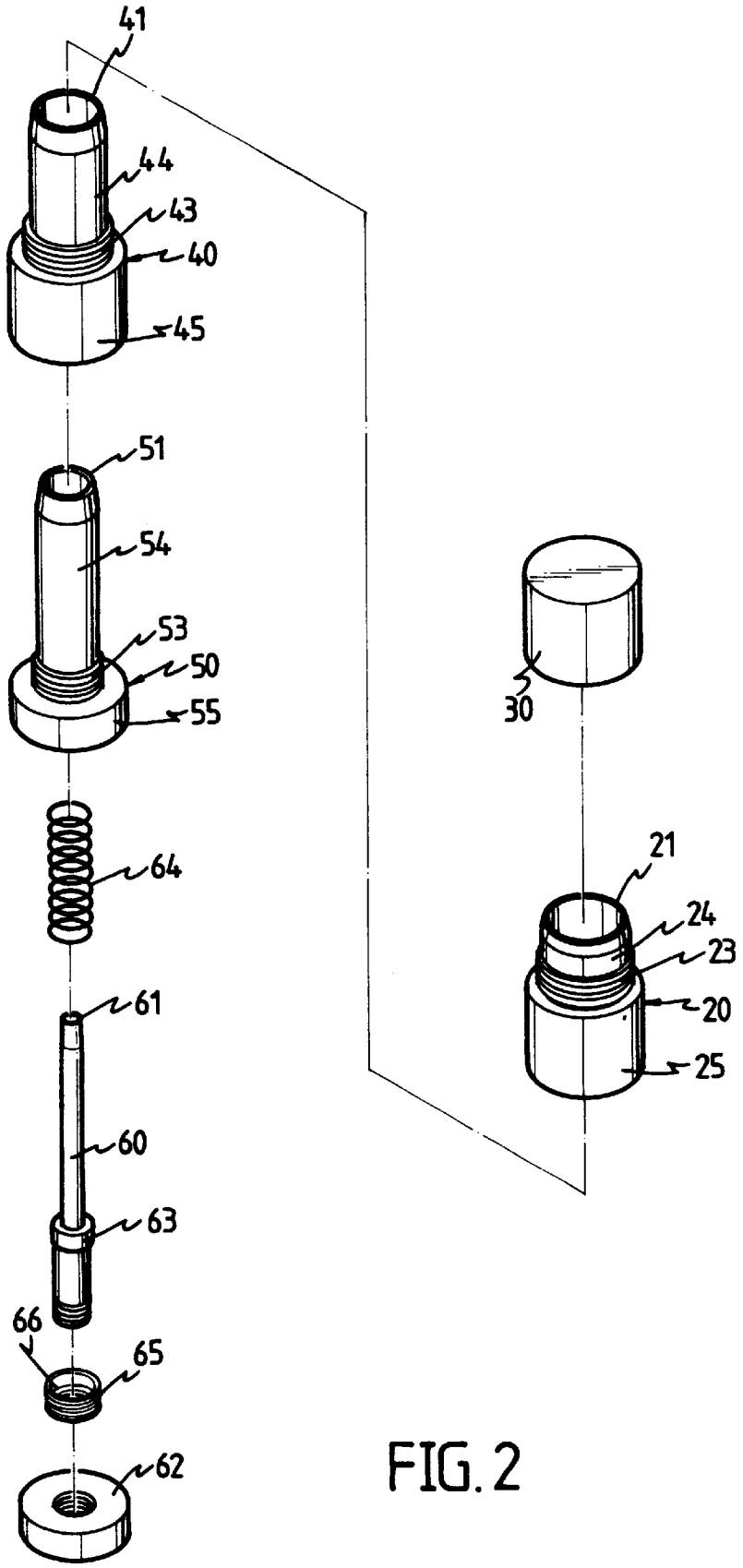
FIG. 2 is an exploded view of the cigar cutting device in accordance with the present invention.
Figure 3:
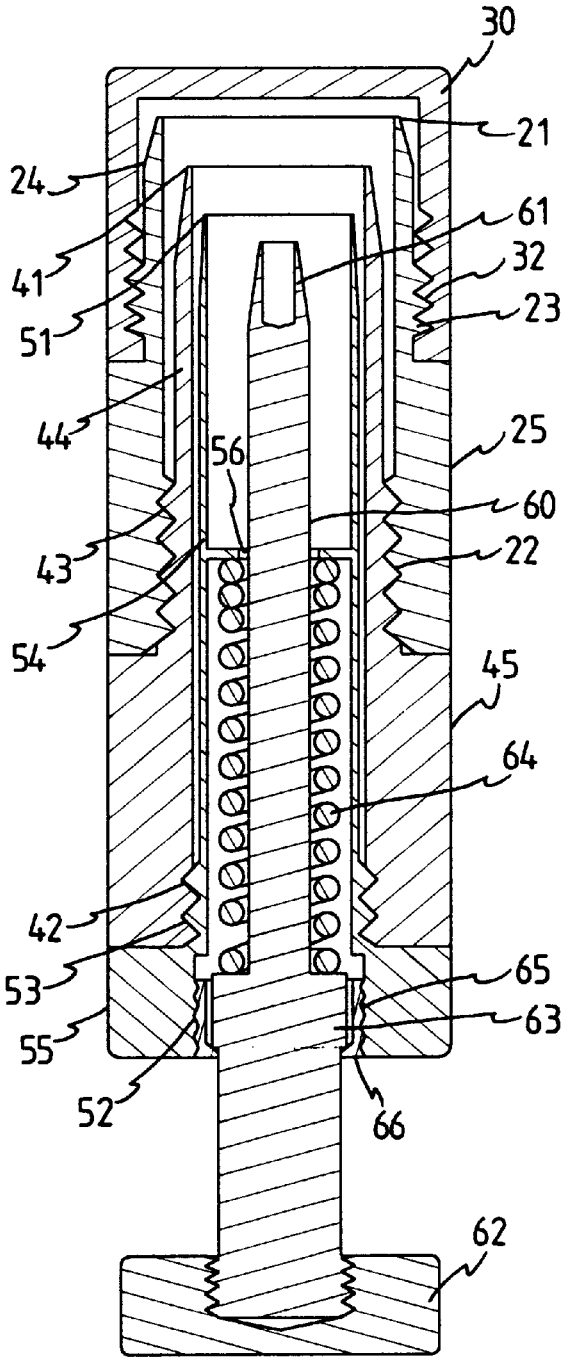
FIG. 3 is a side elevational view, partly in section, of the cigar cutting device in accordance with the present invention.
Figure 4:
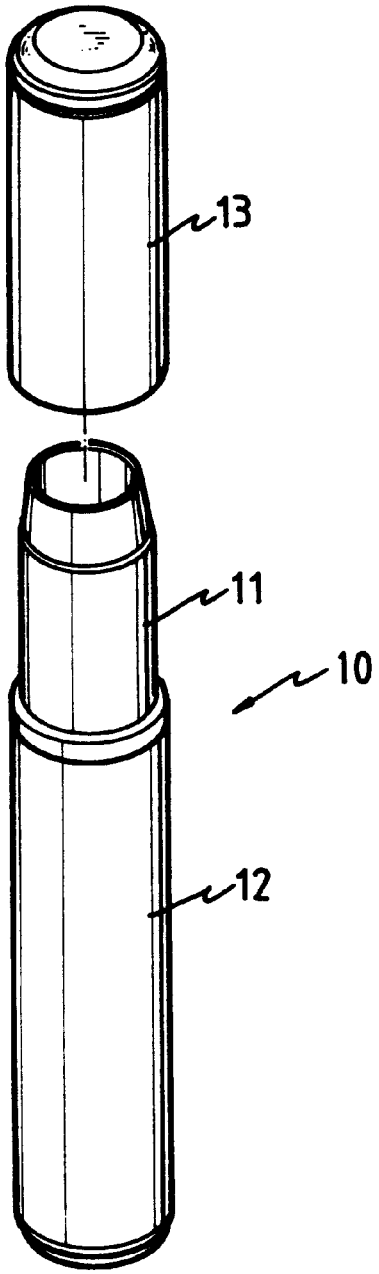
FIG. 4 PRIOR ART
FIG. 4 is an exploded view to show a cap and a conventional cigar cutting device.

Referring to FIGS. 1 to 3, the cigar cutting device in accordance with the present invention comprises a first cutting unit 20, a second cutting unit 40, a third cutting unit 50, a push rod 60 and a cap 30. The first cutting unit 20 has a first tube 25 and a first cutting member 24 extending from the first tube 25. The first cutting member 24 has a first sharp edge 21 and a first outer threaded periphery 23. The first tube 25 has a first inner threaded periphery 22. The cap 30 is threadedly connected to the first outer threaded periphery 23 of the first cutting unit 20.

The second cutting unit 40 has a second tube 45 and a second cutting member 44 extending from the second tube 45. The second cutting member 44 has a second sharp edge 41 which is smaller than that of the first sharp edge 21. The second cutting member 44 has a second outer threaded periphery 43 so as to be engaged with the first inner threaded periphery 22 of the first cutting unit 20. The second tube 45 has a second inner threaded periphery 42.

The third cutting unit 50 has a third tube 55 and a third cutting member 54 extending from the third tube 55. The third cutting member 54 has a third sharp edge 51 which is smaller than that of the second cutting unit 40. The third cutting member 54 has a third outer threaded periphery 53 which is threadedly engaged with the second inner threaded periphery 42 of the second cutting unit 40. The third tube 55 has a third inner threaded periphery 52 so as to be engaged with a ring member 65. The ring member 65 has an annular ridge 66 extending radially inward from the inside thereof.

The third cutting member 54 has an annular flange 56 extending from the inside thereof. The push rod 60 extends from the third tube 55 and through the annular flange 56. The push rod 60 has a flange 63 extending radially outward from the outside thereof and a spring 64 is biased between the annular flange 56 and the flange 63. The flange 63 of the push rod 60 is limited by the annular ridge 66 of the ring member 65 so that the push rod 60 will not disengaged from the third cutting unit 50. The push rod 60 has a sharp edge 61 defined in the first end thereof which is received in the second cutting unit 40, and an end member 62 is connected to the second end of the push rod 60 so that when pushing the end member 62 toward the cap 30, the push rod 60 compresses the spring 64 and will push the cigar end out from the cutting unit.

As shown in FIG. 1, when using the second cutting unit 40, the user holds the first cutting unit 20 and rotates the first cutting unit 20 from the second outer periphery 43 on the second cutting member 44. Accordingly, the user can choose the desired size of the sharp edge 21/41/51 from the cigar cutting device of the present invention. The push rod 60 provides a function to easily remove the cigar from the cutting unit 20/40/50.

While we have shown and described various embodiments in accordance with the present invention, it should be clear to those skilled in the art that further embodiments may be made without departing from the scope and spirit of the present invention.

What is claimed is:

1. A cigar cutting device comprising:

a first cutting unit having a first tube and a first cutting member extending from said first tube, said first cutting member having a first sharp edge, said first cutting member having a first outer threaded periphery and said first tube having a first inner threaded periphery;

a second cutting unit having a second tube and a second cutting member extending from said second tube, said second cutting member having a second sharp edge, said second cutting member having a second outer threaded periphery and said second outer threaded periphery engaged with said first inner threaded periphery, said second cutting member having an annular flange extending from the inside thereof, and a push rod extending from said second tube and through said annular flange, a flange extending radially outward from said push rod and a spring biased between said annular flange and said flange.

2. The device as claimed in claim 1, wherein said push rod has a sharp edge defined in the first end thereof which is received in said second cutting unit, an end member connected to the second end of said push rod.

3. The device as claimed in claim 1, wherein said second tube has a second inner threaded periphery and a ring member is threadedly connected to said second inner threaded periphery, said ring member having an annular ridge extending radially inward from the inside thereof, said flange of said push rod located in said second tube being limited by said annular ridge.

4. The device as claimed in claim 1 further comprising a cap threadedly connected to said first outer threaded periphery of said first cutting unit.

5. The device as claimed in claim 1 further comprising a distance defined between said first sharp edge and said second shaft edge, wherein said second sharp edge is located within said first cutting members.

* * * * *